US007191757B2

(12) United States Patent
Takeuchi et al.

(10) Patent No.: US 7,191,757 B2
(45) Date of Patent: Mar. 20, 2007

(54) THROTTLE CONTROL IN INTERNAL COMBUSTION ENGINE FOR NOISE REDUCTION

(75) Inventors: Nobutaka Takeuchi, Nishikamo-gun (JP); Shinji Nagai, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/542,645

(22) PCT Filed: Apr. 8, 2004

(86) PCT No.: PCT/IB2004/001100

§ 371 (c)(1),
(2), (4) Date: Jul. 19, 2005

(87) PCT Pub. No.: WO2004/090308

PCT Pub. Date: Oct. 21, 2004

(65) Prior Publication Data

US 2006/0130810 A1 Jun. 22, 2006

(30) Foreign Application Priority Data

Apr. 9, 2003 (JP) ..... 2003-105171

(51) Int. Cl.
*F02D 11/10* (2006.01)

(52) U.S. Cl. ..... 123/396

(58) Field of Classification Search ..... 123/396, 123/399
See application file for complete search history.

(56) References Cited

U.S. PATENT DOCUMENTS

| | | | |
|---|---|---|---|
| 5,467,751 | A | 11/1995 | Kumagai |
| 6,439,540 | B1 | 8/2002 | Tse |

FOREIGN PATENT DOCUMENTS

| | | |
|---|---|---|
| DE | 42 05 266 | 4/1993 |
| JP | 59-158347 A | 9/1984 |
| JP | 2001-98958 | 4/2001 |
| JP | 2001-234758 | 8/2001 |

OTHER PUBLICATIONS

Machine translation of JP 2001-234758 A, Nakagawa, Aug. 31, 2001.*

* cited by examiner

*Primary Examiner*—Andrew M. Dolinar
(74) *Attorney, Agent, or Firm*—Kenyon & Kenyon LLP

(57) ABSTRACT

Limitation of the opening rate of the throttle valve is prohibited unless the following conditions have been all satisfied: (i) the engine speed detected at starting opening the throttle valve is below a prescribed speed; (ii) the throttle angle detected at starting opening the throttle valve is below a prescribed throttle angle; (iii) the target throttle-open angle is above a prescribed throttle-open angle; and (ix) the target opening rate of the throttle valve is above a prescribed opening rate.

12 Claims, 6 Drawing Sheets

10. THROTTLE VALVE
11. THROTTLE BODY
12. THROTTLE MOTOR
13. THROTTLE SENSOR
14. ECU
15. ENGINE SPEED SENSOR
16. ACCELERATOR
17. ACCELERATOR SENSOR

THROTTLE CONTROL IN INTERNAL COMBUSTION ENGINE FOR NOISE REDUCTION

This is a 371 national phase application of PCT/IB2004/001100 filed 8 Apr. 2004, claiming priority to Japanese Application No. 2003-105171 filed 9 Apr. 2003, the contents of which are incorporated herein by reference.

BACKGROUND OF THE INVENTION

1. Field of the Invention

The present invention generally relates to throttle control in an internal combustion engine. More specifically, it relates to throttle system and method enabling reduction of air-flow noise occurring in response to changes in the amount of the throttle opening.

2. Description of the Related Art

As is widely known, the quantity of air supplied to an internal combustion engine (will be referred to as "engine" where appropriate) is adjusted at a throttle valve provided in an intake passage of the engine. When the throttle valve quickly opens, it disturbs the flow of air so that the air starts swirling. Such swirl airflow may sometime cause specific noise (will be refereed to as "throttle inflow noise"). Meanwhile, an intake manifold forms one portion of the intake passage, and it is known that a resin-made intake manifold is now increasingly used. Such a resin intake manifold, however, inevitably allows the above-stated throttle inflow noise to be easily propagated or emit to the outside.

To counter this, for example, a known method provides a net or plate in the intake passage to regulate the flow of air downstream of the throttle valve and thereby reduce throttle inflow noise. However, this method involves drawbacks of reduced engine output due to increased air resistance within the intake passage, increased weight, increased production cost, etc. Also, this method is not effective enough to reduce the throttle inflow noise when a resin made intake manifold is used for the reason already mentioned.

In view of the above, another method has been proposed which reduces throttle inflow noise by limiting a rate at which the throttle valve opens (will be referred to as "throttle opening rate") below a specific limit rate under given conditions so that the throttle valve opens relatively slowly (see Japanese Laid-opened Patent Application No. 2001-98958, No. 2001-234758). For example, Japanese Laid-opened Patent Application No. 2001-98958 proposes opening the throttle valve at a lower rate when the throttle angle is smaller than a specific value.

Although it is true that the throttle inflow noise can be reduced by opening the throttle valve at a reduced rate as described above, lowering the throttle opening rate may deteriorate the controllability of the engine output.

SUMMARY OF THE INVENTION

In view of the above situation, the present invention has been made to provide a throttle system and throttle control method for an internal combustion engine enabling reducing throttle inflow noise caused by the throttle valve being opened while minimizing deterioration of the controllability of the engine output.

To achieve the above object, a first aspect of the invention relates to a throttle system for an internal combustion engine including a throttle valve, accelerating means operated by an operator to adjust an engine output of the internal combustion engine, and throttle valve controlling means for controlling the throttle valve to open in accordance with the manner in which the accelerating means has been operated. The throttle valve controlling means is adapted to execute under given conditions a throttle opening rate limitation limiting a throttle opening rate at which the throttle valve is opened, below a limit opening rate. This throttle system also includes engine speed detecting means for detecting an engine speed of the internal combustion engine, and the throttle valve controlling means prohibits the throttle opening rate limitation if the engine speed detected via the engine speed detecting means at starting opening the throttle valve is above a prescribed engine speed.

A research of the inventors has revealed that throttle inflow noise does not occur unless the throttle valve quickly opens where the engine speed is lower than a specific speed. Therefore, the throttle system of the first aspect has the foregoing structure to avoid the throttle opening rate being unnecessary limited when no or almost no throttle inflow noise is likely to occur. Thus, it is possible to reduce throttle inflow noise advantageously while minimizing deterioration of the controllability of the engine output.

In another form of the invention, it is preferable that engine torque detecting means for detecting engine torque of the internal combustion engine be provided, and that the throttle valve controlling means be further adapted to prohibit the throttle opening rate limitation if the engine torque detected via the engine torque detecting means at starting opening the throttle valve is above a prescribed engine torque.

The research of the inventors also revealed that throttle inflow noise does not occur unless the throttle valve quickly opens where the magnitude of the engine torque is lower than a certain level. Therefore, the foregoing structure of the throttle system improves the reliability in avoiding the throttle opening rate being unnecessary limited when no or almost no throttle inflow noise is likely to occur, and this leads to a further improvement in the effect of reducing throttle inflow noise while minimizing deterioration of the controllability of the engine output.

In another form of the invention, it is preferable that throttle opening amount detecting means for detecting an opening amount of the throttle valve be provided, and that the throttle valve controlling means be further adapted to prohibit the throttle opening rate limitation if the opening amount of the throttle valve detected via the throttle opening amount detecting means at starting opening the throttle valve is above a prescribed opening amount.

As aforementioned, throttle inflow noise does not occur unless the throttle valve quickly opens where the engine torque is below a certain level, and it is possible, as is widely known, to determine the magnitude of the engine torque based on the opening amount of the throttle valve. Therefore, the foregoing structure of the throttle system further improves the reliability in avoiding the throttle opening rate being unnecessary limited when no or almost no throttle inflow noise is likely to occur, and this leads to a further improvement in the effect of reducing throttle inflow noise while minimizing deterioration of the controllability of the engine output.

In another form of the invention, it is preferable that the throttle valve controlling means be further adapted to (I) determine based on the manner in which the accelerating means has been operated whether the throttle valve is required to open quickly and (ii) prohibit the throttle opening rate limitation if the throttle valve is not required to open quickly.

Throttle inflow noise does not occur unless the throttle valve opens at a rate higher than a certain level. Therefore, the foregoing structure of the throttle system further improves the reliability in avoiding the throttle opening rate being unnecessary limited when no or almost no throttle inflow noise is likely to occur, and this leads to a further improvement in the effect of reducing throttle inflow noise while minimizing deterioration of the controllability of the engine output.

In another form of the invention, it is preferable that the throttle controller be further adapted to (i) determine a target throttle-open amount by which the throttle valve is required to open and a target throttle opening rate at which the throttle valve is required to open based on the manner in which the accelerating means has been operated, and (ii) prohibit the throttle opening rate limitation if the target throttle-open amount is below a prescribed throttle-open amount or if the target throttle opening rate is below a prescribed opening rate.

It is not necessary to execute the throttle opening rate limitation if the throttle body is not required to open quickly. Therefore, the foregoing structure of the throttle system further improves the reliability in avoiding the throttle opening rate being unnecessary limited when no or almost no throttle inflow noise is likely to occur, and this leads to a further improvement in the effect of reducing throttle inflow noise while minimizing deterioration of the controllability of the engine output.

In another form of the invention, it is preferable that the throttle controlling means be further adapted to (i) determine whether the opening amount of the throttle valve is changing across a predetermined range thereof, and (ii) prohibit the throttle opening rate limitation if the opening amount is not changing across the predetermined range.

The research of the inventors also revealed that throttle inflow noise does not occur unless the throttle opening amount is changing across a certain range. Therefore, the foregoing structure of the throttle system further improves the reliability in avoiding the throttle opening rate being unnecessary limited when no or almost no throttle inflow noise is likely to occur, and this leads to a further improvement in the effect of reducing throttle inflow noise while minimizing deterioration of the controllability of the engine output.

A second aspect of the invention relates to a throttle system for an internal combustion engine, including a throttle valve, accelerating means operated by an operator to adjust an engine output of the internal combustion engine, and throttle valve controlling means for controlling the throttle valve to open in accordance with the manner in which the accelerating means has been operated. The throttle valve controlling means executes under given conditions a throttle opening rate limitation limiting a throttle opening rate at which the throttle valve is opened, below a limit opening rate. Further, in this throttle system, the throttle valve controller is adapted to (i) determine whether the throttle opening amount is changing across a predetermined range thereof, and (ii) prohibit the throttle opening rate limitation if the throttle opening amount is not changing across the predetermined range.

A third aspect of the invention relates to a method for controlling a throttle valve of an internal combustion engine. This method includes (i) executing under given conditions a throttle opening rate limitation limiting a throttle opening rate at which the throttle valve is opened, below a limit opening rate, and (ii) prohibiting the throttle opening rate limitation if an engine speed detected at starting opening the throttle valve is above a prescribed engine speed.

A fourth aspect of the invention relates to a method for controlling a throttle valve of an internal combustion engine. This method includes (i) executing under given conditions a throttle opening rate limitation limiting a throttle opening rate at which the throttle valve is opened, below a limit opening rate, and (ii) prohibiting the throttle opening rate limitation if an opening amount of the throttle valve is not changing across a predetermined range thereof.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF THE PREFERRED EXEMPLARY EMBODIMENTS

Hereinafter, a throttle system for an internal combustion engine in accordance with one exemplary embodiment of the invention will be described with reference to the accompanying drawings.

Figure 1:
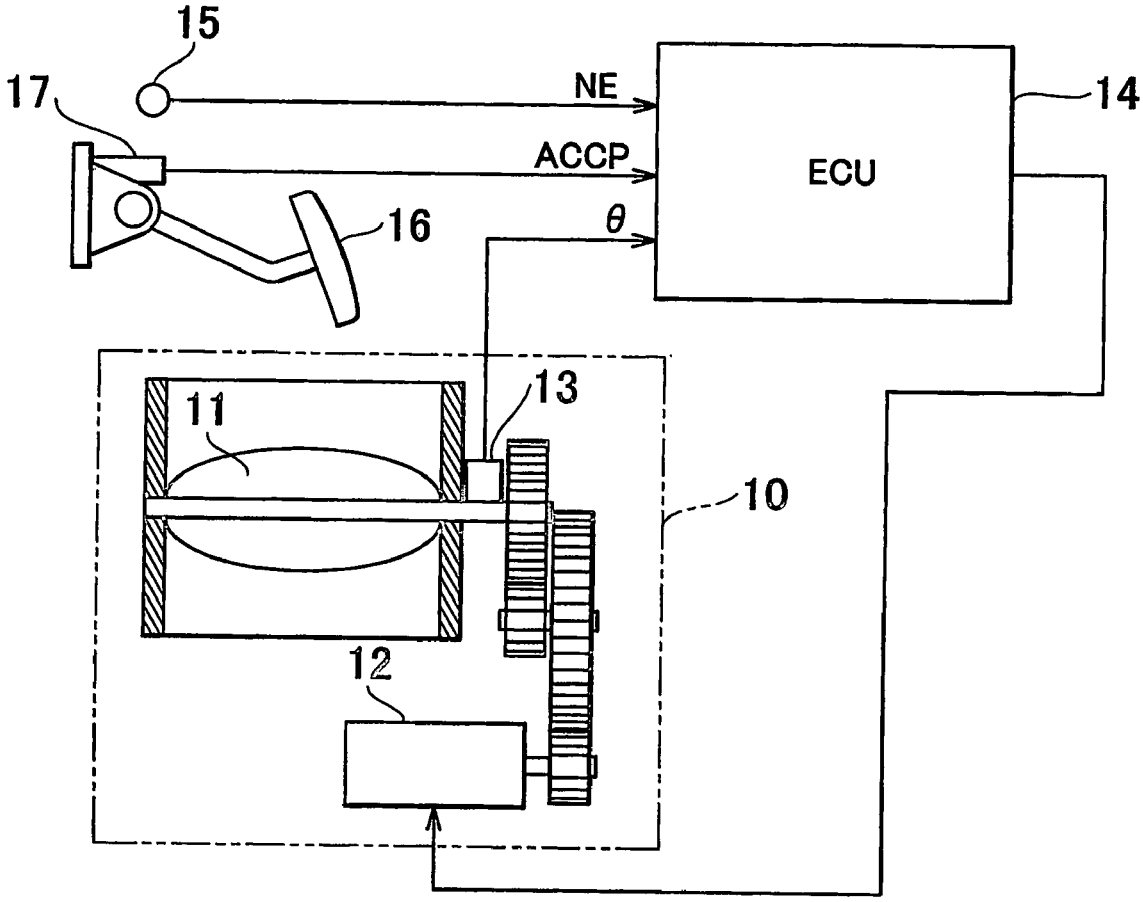
FIG. 1 is a view schematically showing the configuration of a throttle system according to one exemplary embodiment of the invention.

FIG. 1 is a view schematically showing the configuration of the throttle system of the exemplary embodiment. Referring to FIG. 1, the throttle system is provided with a throttle valve 10 disposed along an intake passage of the internal combustion engine (will be simply referred to as "engine"). The air drawn via an air duct, not shown, into the intake passage passes through a throttle body 11 of the throttle valve 10, a surge tank, and an intake manifold, both not shown, and is finally introduced into each combustion chamber.

As well as the throttle body 11, the throttle valve 10 includes a throttle motor 12 and a throttle sensor 13. The shaft of the throttle body 11 is coupled to the throttle motor 12, and the throttle sensor 13 is disposed near the same shaft.

The throttle motor 12 drives the throttle body 11 to change its angle (will be referred to as "throttle angle"). More specifically, the angle of the throttle body 11 is changed so as to adjust the sectional area of the intake passage and thus change the flow rate of the air flowing therethrough. Namely, this changes the rate at which air is supplied to the engine. The throttle sensor 13 measures the angle of the throttle body 11 (throttle angle θ).

The throttle system includes an ECU (Electronic Control Unit) 14 governing the operation of the throttle valve 10. The ECU 14 includes an CPU for executing various programs to control the throttle valve 10, a memory storing those programs, input and output communication ports each outputting or receiving various signals from/to external elements.

In this exemplary embodiment, as well as the throttle sensor 13, the throttle system includes various other sensors, such as an engine speed sensor 15 for detecting the speed of the engine (engine speed NE) and an accelerator sensor 13 for detecting the amount an accelerator 17 is operated by an operator (accelerator operation amount ACCP). Such sensors are all connected to the above-stated input communication port of the ECU 14 so that the ECU 14 receives signals from them. The output communication port of the ECU 14, on the other hand, is connected to the throttle motor 12 so that the ECU 14 controls the throttle valve 10.

In operation, the ECU 14 computes a target throttle angle θ based on the engine speed NE detected via the engine speed sensor 15 and the accelerator operation amount ACCP detected via the accelerator sensor 17. Then, the ECU 14 controls the throttle motor 12 such that the actual throttle angle θ matches the target throttle angle θt computed. In this exemplary embodiment, the throttle angle θ (i.e., rotational angle of the valve shaft of the throttle body 11) is 0 degree when the throttle body 11 is fully closed and increases as the throttle body 11 rotates from that closed position.

The inventors of the present invention conducted a research regarding throttle inflow noise caused by the throttle angle being changed, and they discovered that throttle inflow noise dose not always occur when the throttle angle changes quickly unless some other conditions are also satisfied. More specifically, throttle inflow noise does not occur unless the throttle body 11 quickly opens where the engine speed (engine speed NE) is below a prescribed speed (engine speed NE1) (condition A) and the engine torque (engine torque TR) is below a prescribed toque TR1 (condition B).

Figure 2:
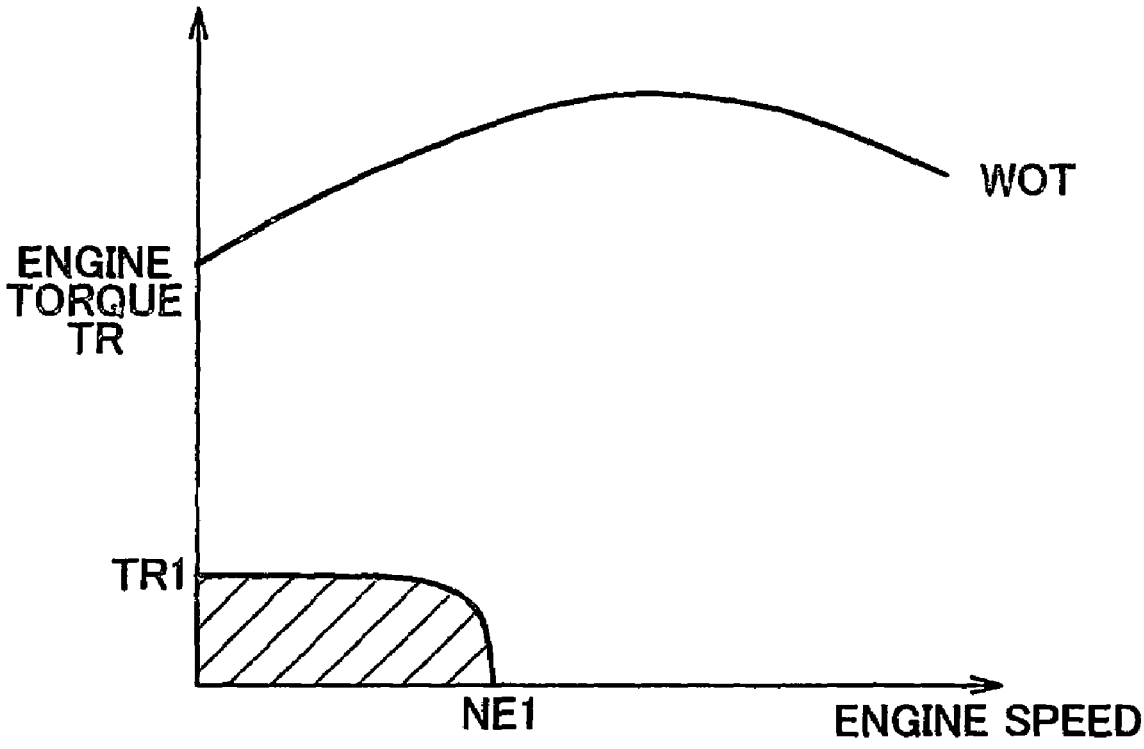
FIG. 2 is a graph illustrating a region in which throttle inflow noise occurs, defined by the values of engine speed and engine torque detected at starting opening a throttle valve.
Figure 3:
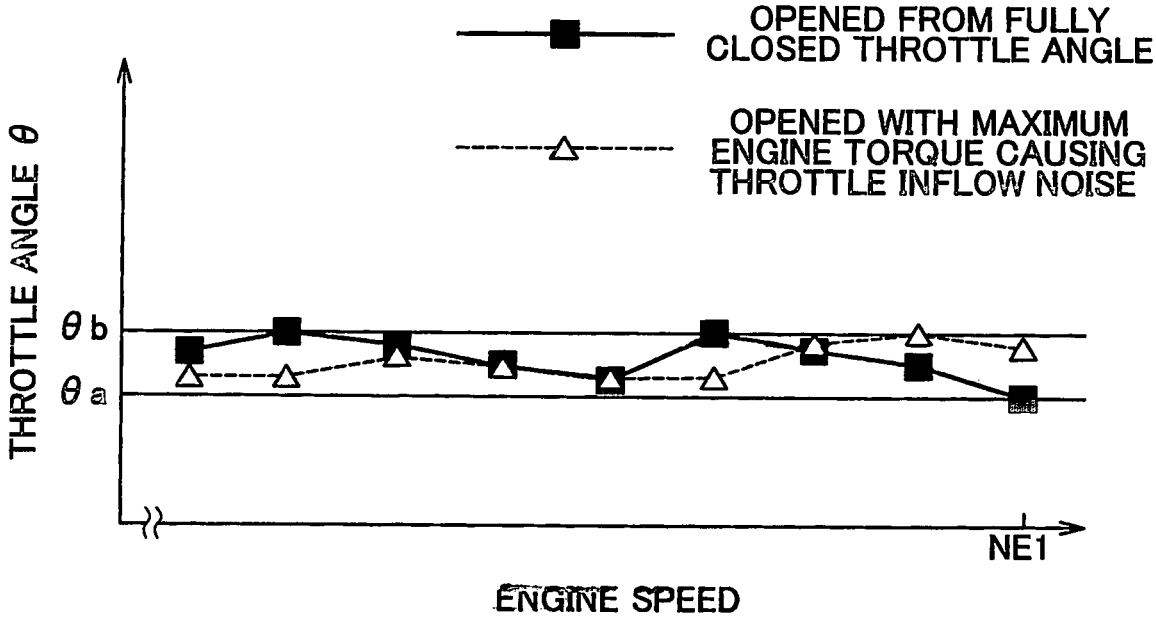
FIG. 3 is a graph illustrating the relationship between the engine speed detected at starting opening the throttle body and the throttle angle at which throttle inflow noise occurs while the throttle body is being opened.

FIG. 2 is a graph illustrating a region in which occurrence of throttle inflow noise has been acknowledged during the research, which is defined by the engine speed NE and the engine torque TR detected at starting opening the throttle body 11. In FIG. 3, the curve WOT represents the maximum value of the engine toque TR that is correlative with the engine speed NE.

As evident from the graph, whether throttle inflow noise occurs largely depends on the values of the engine speed NE and engine torque TR at starting opening the throttle body 11. That is, throttle inflow noise does not occur unless the throttle valve quickly opens with the above conditions A, B both satisfied, i.e., with the engine speed NE being below NE1 and the engine torque TR being below TR1.

For example, the magnitude of the engine torque TR generated at a specific engine speed may be obtained as a function of the throttle angle θ. In this case, therefore, the above-stated condition B may be modified to "throttle angle θ is below a predetermined angle θ1" (condition B').

In the case of the internal combustion engine used in this exemplary embodiment, according to the result of the research, throttle inflow noise occurs when the throttle body 11 quickly opens at an engine speed (NE) lower than 3000 rpm and a throttle angle (θ) smaller than 9 degrees.

FIG. 3 is a graph illustrating the relationship between the engine speed NE detected at starting opening the throttle body 11 and the throttle angle θ at which throttle inflow noise occurs while the throttle body 11 is opening. In this graph, the solid line curve represents the throttle angle θ at which throttle inflow noise occurs when the throttle body 11 quickly opens from the fully closed position, whereas the dotted line curve represents the throttle angle θ at which throttle inflow noise occurs when the throttle body 11 quickly opens where the engine torque (TR) is at its upper limit value within a range causing throttle inflow noise.

Referring to FIG. 3, even if the throttle body 11 opens where the above-stated conditions A, B are both satisfied, throttle noise will not occur unless the throttle angle θ is within a specific range thereof. That is, throttle inflow noise only occurs when throttle angle θ is changing across a range from a lower limit angle θa to a upper limit value θb, and this range of throttle angle θ will hereinafter be referred to as "noise range." In this exemplary embodiment, the lower limit angle θa is 20 degrees while the upper limit angle θb is 30 degrees.

As described above, throttle inflow noise only occurs under such specific conditions. Thus, the noise can be reduced sufficiently even if the opening rate of the throttle body 11 is limited to a limit value only when those conditions have been satisfied. By thus restricting limitation of the throttle opening rate, it is possible to avoid deterioration of the controllability of the engine output which may otherwise be caused by the throttle opening rate being limited unnecessarily.

To avoid such unnecessary limitation of the throttle opening rate, therefore, the ECU 14 determines whether to execute the throttle opening rate limitation as follows. Hereinafter, a control executed by the ECU 14 to limit the opening rate ω of the throttle body 11 below a specific limit value will be referred to as "throttle opening rate limitation". First, the ECU 14 determines if conditions a, b have been satisfied. The condition a requires the engine speed NE detected at starting opening the throttle body 11 be less than a prescribed engine speed NE1 which is, for example, set to 3000 rpm. The condition b requires the throttle angle θ detected at starting opening the throttle body 11 be smaller than a prescribed angle θ1 which is, for example, set to 9 degrees. If either condition is not satisfied, the ECU 14 prohibits the throttle opening rate limitation.

In addition, the ECU 14 also determines if the manner in which the accelerator 16 has been operated requires the throttle body 11 to open quickly. At this time, the ECU 14 refers to changes in the accelerator operation amount ACCP. Through such determination, it becomes clear whether the throttle body 11 is required to open quickly. If not, the ECU 14 prohibits the throttle opening rate limitation.

In this exemplary embodiment, the ECU 14 determines whether the throttle body 11 is required to open quickly by evaluating conditions c, d. The condition c requires that a target throttle-open angle Δθt be above a prescribed angle Δθ1, while the condition d requires a target throttle opening rate ω be above a prescribed rate ω1. The target throttle-open angle Δθt is an angle by which the throttle body 11 is required to open, and this angle is determined based on the manner in which the accelerator 16 has been operated. Likewise, the target throttle opening rate ωt is a rate at which the throttle body 11 is required to open, and this rate also is determined based on the same manner. The manner in which the accelerator 16 has been operated may be defined by, for example, the amount or rate of increase in the accelerator operation amount ACCP, and will be referred to as "accelerator operation manner" where appropriate.

As aforementioned, the ECU 14 does not carry out the throttle opening rate limitation if the throttle angle θ detected at starting opening the throttle body 11 is below the prescribed angle θ1 (condition b). Along with this, the ECU 14, when evaluating condition c, determines whether the target throttle angle θt is above a prescribed throttle angle θ2 (=θ1+Δθ1).

Even if the above conditions have been all satisfied, however, the ECU 14 does not carry out the throttle opening rate limitation, namely does not limit the opening rate ω to a limit opening rate ω2 unless the throttle angle is within the above-stated noise range (θa<θ<θb). That is, the ECU 14 simply opens the throttle body 11 at a rate required by the accelerator operation manner regardless of whether the conditions a, b, c, d have been all satisfied if the throttle angle θ is out of the noise range. The limit opening rate ω2 may preferably be set as large as possible within a range where throttle inflow noise can be reduced to an allowable level.

Figure 4:
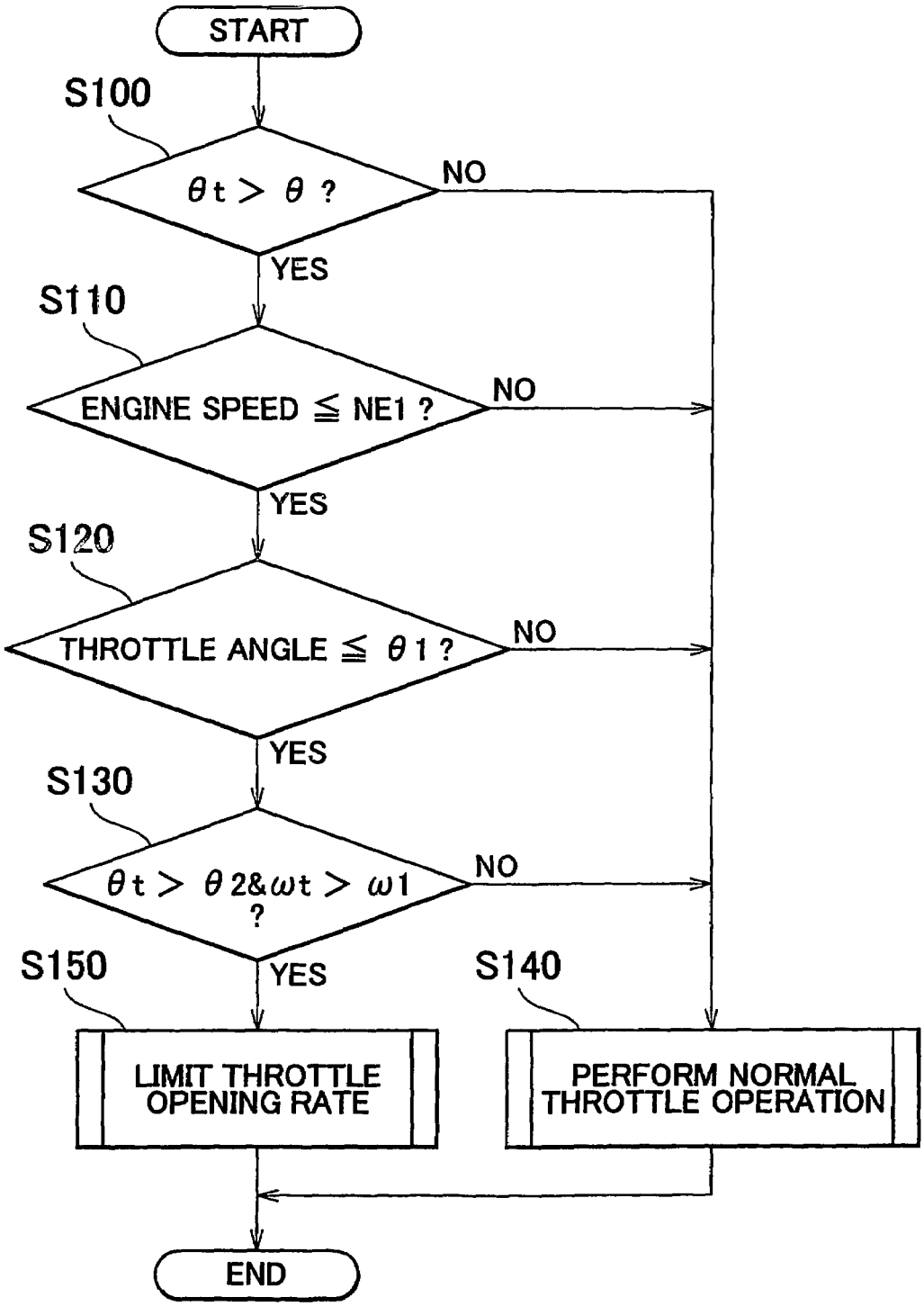
FIG. 4 is a flowchart showing one exemplary routine for determining whether to execute the throttle opening rate limitation.

The flowchart of FIG. 4 represents one exemplary routine executed by the ECU 14 to determine whether to execute the throttle opening rate limitation. The ECU 14 repeats this routine as a subroutine at predetermined intervals.

Referring to FIG. 4, the ECU 14 first determines in step S100 whether the target throttle angle θ is larger than the present throttle angle θ. This step refers to whether the throttle body 11 is now required to open.

If NO in step S100, namely if it is required to close or maintain the throttle body 11, the ECU 14 then resumes a normal throttle control in step S140 so that the present throttle angle θ will be maintained or reduced as needed. In this normal throttle control, the ECU 14 simply controls the throttle angle θ in accordance with the accelerator operation manner.

If YES in step S100, namely if it is now required to open the throttle body 11, the ECU 14 then executes steps S110 to 130 to see if each of the conditions a, b, c, d is satisfied. Here, step S110 determines whether the engine speed NE is below the prescribed speed NE1 (condition a), and step S120 determines whether the throttle angle θ is below the prescribed angle θ1 (condition b), and step S130 determines whether the target throttle angle θt is above the prescribed angle θ2 (condition c) and whether the target opening rate ωt of the throttle body 11 is above the prescribed rate ω1 (condition d).

If any one of the above conditions is not satisfied, the ECU 14 proceeds to step S140 to resume the normal throttle control. When the conditions have all been satisfied, conversely, the ECU 14 then proceeds to step S150 to carry out the throttle opening rate limitation, as will be described later.

Figure 5:
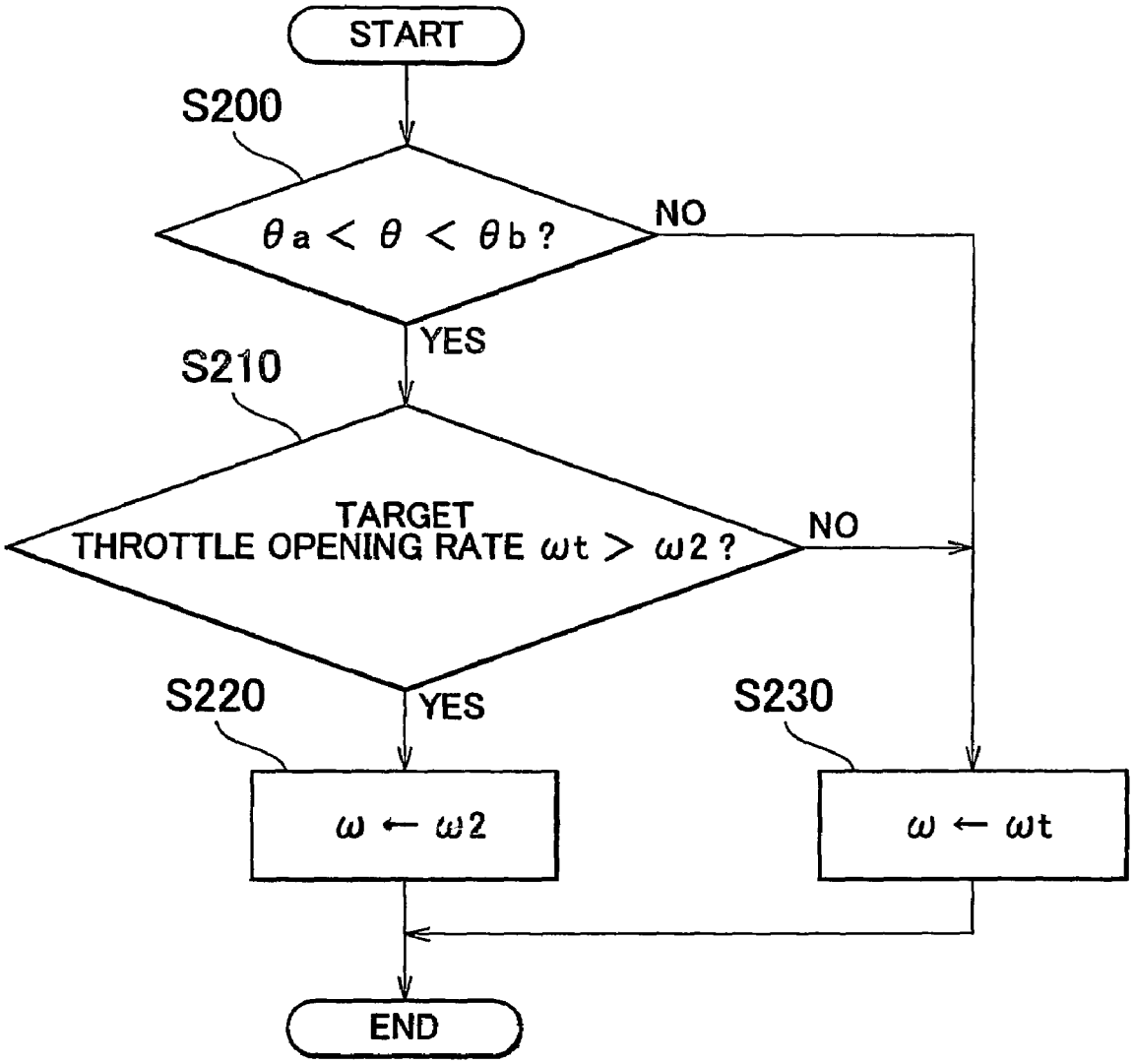
FIG. 5 is a flowchart showing one exemplary routine for limiting the throttle opening rate (i.e., throttle opening rate limitation)

The flowchart of FIG. 5 represents one exemplary routine of the throttle opening rate limitation. Referring to FIG. 5, the ECU 14 first determines in step S200 whether the present throttle angle θ detected via the throttle sensor 13 is within the noise range (θa<θ<θb). If YES, the ECU 14 then determines whether the target throttle opening rate ωt is above the limit opening rate ω2.

If the ECU 14 determines "NO" in either step above, it proceeds to step S230 and sets the throttle opening rate ω to the required opening rate ωt. If the ECU 14 determines "YES" in both steps, conversely, it proceeds to step S220 and sets the throttle opening rate ω to the limit opening rate ω2.

After the throttle opening rate ω has been set as above, the ECU 14 finishes the routine temporarily and drives the throttle motor 12 such that the throttle body 11 opens at the throttle opening rate ω thus set.

Figure 6:
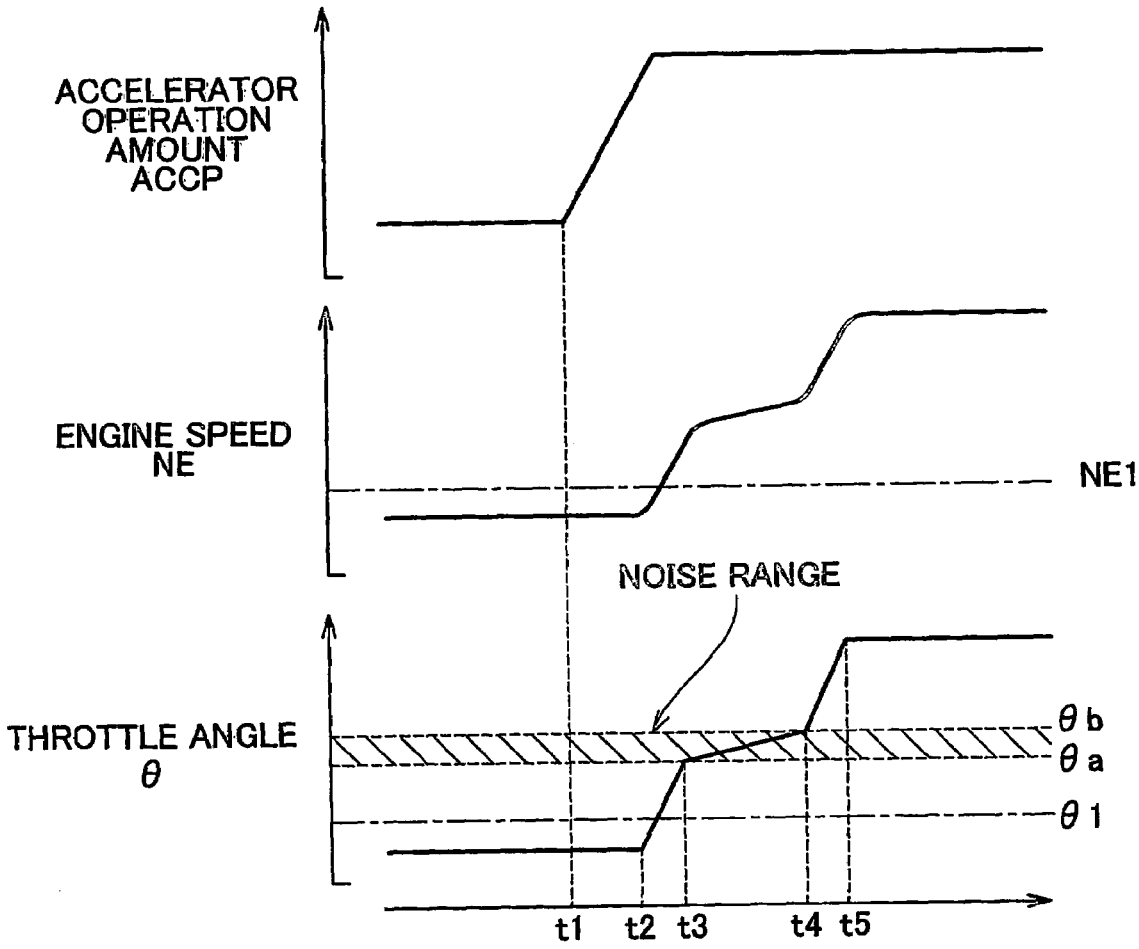
FIG. 6 is a timechart illustrating one example for explaining the operation of the throttle control system of the exemplary embodiment.

FIG. 6 is a timechart illustrating one example for more clearly explaining the operation of the throttle control system of the exemplary embodiment. In this example, the accelerator 16 is first operated at time t1 thus requiring the throttle body 11 to open.

This example starts from time t1 where the engine speed NE is below the prescribed speed NE1 (condition a satisfied) and the throttle angle θ is below the prescribed angle θ (condition b satisfied). First, the accelerator 16 is operated at time t1 in a manner satisfying the above-stated conditions c, d.

Subsequently, the throttle angle θ starts increasing at time t2 in response to the accelerator 16 operated from time t1. At this time, the throttle angle θ changes at a rate corresponding to the accelerator operation manner.

Then, in response to the throttle angle θ reaching the lower limit of the noise range at time t3, the throttle opening rate ω is then limited to the limit opening rate ω2. This limitation of the throttle opening rate ω continues until the throttle angle θ exceeds the upper limit of the noise range at time t4.

At time t4, the throttle opening rate ω is again increased at a rate corresponding to the accelerator operating manner, and the throttle opening rate ω thus increased is maintained until the throttle angle θ reaches the target throttle angle θt at time t5.

Below are described advantages obtained with the throttle system described above:

(1) Since limitation of the throttle opening rate ω is prohibited when the engine speed NE is above the prescribed speed NE1, the throttle opening rate ω is not unnecessarily limited when throttle inflow noise is not likely to occur. Thus, it is possible to adventurously avoid throttle inflow noise while minimizing deterioration of the controllability of the engine output.

(2) Since limitation of the throttle opening rate ω is carried out only when the engine speed NE is below the prescribed speed NE1 and the throttle angle θ is smaller than the prescribed angle θ1 (i.e., the engine toque TR is small). This improves the advantage of avoiding unnecessary limitation of the throttle opening rate.

(3) Limitation of the throttle opening rate ω is also prohibited when the required throttle open angle Δθ is below the prescribed angle Δθ1 and the target throttle opening rate ωis below the prescribed opening rate ω1. In this way, limitation of the throttle opening rate ωis avoided in the case where the throttle body 11 is to be slowly opened and thus no or almost no throttle inflow noise will occur. This leads to a further improvement in the effect of avoiding unnecessary limitation of the throttle opening rate.

(4) Limitation of the throttle opening rate ω is also prohibited unless the throttle angle θ is changing across the noise range (θa<θ<θb), in other words. This leads to a further improvement in the effect of avoiding unnecessary limitation of the throttle opening rate.

Hereinafter, some examples of modifications which may be made to the throttle system of the above exemplary embodiment will be described.

(a) While the ECU 14 makes the determination as to the engine torque TR by referring to the throttle angle θ in step S120 of FIG. 4, the ECU 14 may instead refer to other parameter that is correlative to the engine torque TR.

(b) While the ECU 14 makes the determination in step S130 of FIG. 4 based on the required throttle-open angle Δθ and the target throttle opening rate ωt, it may instead use other parameters as long as whether the throttle body 11 is required to open quickly can be appropriately determined. For example, the accelerator operation amount ACCP or the increase amount or rate of the target throttle angle θt may be utilized as such parameters.

(c) While the ECU 14, in the procedure shown in FIG. 5, carries out limitation of the throttle opening rate only when the throttle angle θ is changing across the noise range, other condition for carrying out the limitation may be applied. That is, throttle inflow noise can be reduced while avoiding unnecessary limitation of the throttle opening rate if execution of the throttle opening rate limitation is restricted according to specific conditions determined using the engine speed NE detected at starting opening the throttle body 11, etc.

(d) The ECU 14 may skip step S130 of FIG. 4. Even in this case, since the throttle opening rate limitation is prohibited depending on the engine speed NE and the throttle angle θ as described above, unnecessary limitation of the throttle opening rate is advantageously avoided.

(e) The ECU 14 may skip step S120 of FIG. 4. Even in this case, since the throttle opening rate limitation is prohibited depending on the engine speed NE and the necessity to open the throttle body 11 quickly, unnecessary limitation of the throttle opening rate is advantageously avoided.

(f) The ECU 14 may skip both the above two steps. Even in this case, since the throttle opening rate limitation is prohibited depending on the engine speed NE, unnecessary limitation of the throttle opening rate is advantageously avoided.

(g) The ECU 14 may skip the whole routine shown in FIG. 4 and only execute the routine shown in FIG. 5. Even in this case, since limitation of the throttle opening rate is prohibited unless the throttle angle θ is within the noise region, it is possible to reduce throttle inflow noise while avoiding unnecessary limitation of the throttle opening rate which may lead to deterioration of the controllability of the engine output.

While the invention has been described with reference to preferred embodiments thereof, it is to be understood that the invention is not limited to the preferred embodiments or constructions. To the contrary, the invention is intended to cover various modifications and equivalent arrangements other than described above. In addition, while the various elements of the preferred embodiments are shown in various combinations and configurations, which are exemplary, other combinations and configurations, including more, less or only a single element, are also within the spirit and scope of the invention.

What is claimed is:

1. A method for controlling a throttle valve of an internal combustion engine, comprising:

executing under given conditions a throttle opening rate limitation limiting a throttle opening rate at which the throttle valve is opened, below a limit opening rate; and prohibiting the throttle opening rate limitation if an engine speed of the internal combustion engine detected at starting opening the throttle valve is above a prescribed engine speed.

2. A method as set forth in claim 1, further comprising:

prohibiting the throttle opening rate limitation if an engine torque of the internal combustion engine detected at starting opening the throttle valve is above a prescribed engine torque.

3. A method as set forth in claim 1, further comprising:

prohibiting the throttle opening rate limitation if an opening amount of the throttle valve detected at starting opening the throttle valve is above a prescribed opening amount.

4. A method as set forth in claim 1, further comprising:

prohibiting the throttle opening rate limitation if the throttle valve is not required to open quickly.

5. A method as set forth in claim 1, further comprising:

determining a target throttle-open amount by which the throttle valve is required to open and a target throttle opening rate at which the throttle valve is required to open; and prohibiting the throttle opening rate limitation if the target throttle-open amount is below a prescribed throttle-open amount or if the target throttle opening rate is below a prescribed opening rate.

6. A method as set forth in claim 1, further comprising:

prohibiting the throttle opening rate limitation if an opening amount of the throttle valve is not changing across a predetermined range thereof.

7. A throttle system for an internal combustion engine, comprising:

a throttle valve;

an accelerator operated by an operator to adjust an engine output of the internal combustion engine;

an engine speed detector for detecting an engine speed of the internal combustion engine; and a throttle valve controller that is adapted to:

control the throttle valve to open in accordance with a manner in which the accelerator has been operated, execute under given conditions a throttle opening rate limitation limiting a throttle opening rate at which the throttle valve is opened, below a limit opening rate, and prohibit the throttle opening rate limitation if the engine speed detected via the engine speed detector at starting opening the throttle valve is above a prescribed engine speed.

8. A throttle system as set forth in claim 7, further comprising an engine torque detector for detecting an engine torque of the internal combustion engine, wherein the throttle valve controller is further adapted to prohibit the throttle opening rate limitation if the engine torque detected via the engine torque detector at starting opening the throttle valve is above a prescribed engine torque.

9. A throttle system as set forth in claim 7, further comprising a throttle opening amount detector for detecting an opening amount of the throttle valve, wherein the throttle valve controller is further adapted to prohibit the throttle opening rate limitation if the opening amount of the throttle valve detected via the throttle opening amount detector at starting opening the throttle valve is above a prescribed opening amount.

10. A throttle system as set forth in claim 7, wherein the throttle valve controller is further adapted to:

determine based on the manner in which the accelerator has been operated whether the throttle valve is required to open quickly, and prohibit the throttle opening rate limitation if the throttle valve is not required to open quickly.

11. A throttle system as set forth in claim 7, wherein the throttle controller is further adapted to:

determine a target throttle-open amount by which the throttle valve is required to open and a target throttle opening rate at which the throttle valve is required to open based on the manner in which the accelerator has been operated, and prohibit the throttle opening rate limitation if the target throttle-open amount is below a prescribed throttle-open amount or if the target throttle opening rate is below a prescribed opening rate.

12. A throttle system as set forth in claim 7, wherein the throttle controller is further adapted to:

determine whether the opening amount of the throttle valve is changing across a predetermined range thereof, and prohibit the throttle opening rate limitation if the opening amount is not changing across the predetermined range.

* * * * *

UNITED STATES PATENT AND TRADEMARK OFFICE

CERTIFICATE OF CORRECTION

PATENT NO. : 7,191,757 B2
APPLICATION NO. : 10/542645
DATED : March 20, 2007
INVENTOR(S) : Takeuchi et al.

It is certified that error appears in the above-identified patent and that said Letters Patent is hereby corrected as shown below:

| Column | Line | |
|---|---|---|
| 5 | 35 | Change “dose” to --does--. |
| 5 | 49 | Change “toque” to --torque--. |
| 6 | 59 | Change “ω” to --ωt--. |
| 8 | 35 | Change “adventurously” to --advantageously--. |
| 8 | 41 | Change “toque” to --torque--. |
| 8 | 47 | Change “ωis” to --ω is--. |
| 8 | 48 | Change “ωis” to --ω is--. |

Signed and Sealed this

Seventh Day of August, 2007

JON W. DUDAS
*Director of the United States Patent and Trademark Office*